United States Patent [19]

Dück

[11] Patent Number: 4,745,851

[45] Date of Patent: May 24, 1988

[54] PROCESS FOR THE CONSTRUCTION OF A GAS-TIGHT, THERMALLY INSULATED LINING FOR A FREE-STANDING STACK

[75] Inventor: Jan Dück, Frankfurt am Main, Fed. Rep. of Germany

[73] Assignee: Hoechst Aktiengesellschaft, Fed. Rep. of Germany

[21] Appl. No.: 894,892

[22] Filed: Aug. 8, 1986

[30] Foreign Application Priority Data

Aug. 9, 1985 [DE] Fed. Rep. of Germany ..... 3528653

[51] Int. Cl.[4] ..... F23J 13/02

[52] U.S. Cl. ..... 98/58; 138/147; 138/DIG. 2

[58] Field of Search ..... 98/60; 110/184; 126/307 R; 138/140, 147, DIG. 2, DIG. 7

[56] References Cited

U.S. PATENT DOCUMENTS

| | | | |
|---|---|---|---|
| 3,367,075 | 2/1968 | Pierce et al. | 98/58 X |
| 4,216,709 | 8/1980 | Bottenbruch | 98/58 |
| 4,567,700 | 2/1986 | Snook | 98/58 X |

FOREIGN PATENT DOCUMENTS

| | | | |
|---|---|---|---|
| 2615603 | 10/1977 | Fed. Rep. of Germany | 98/58 |
| 1177258 | 1/1970 | United Kingdom | 98/58 |
| 1265216 | 3/1972 | United Kingdom | 98/58 |

*Primary Examiner*—Harold Joyce

*Attorney, Agent, or Firm*—Berman, Aisenberg & Platt

[57] ABSTRACT

In this process a laminate of glass fiber and multicomponent reaction resin, and on top of this a layer of thermal insulation, is placed on the outer side of the stack lining composed of masonry or concrete which is resistant to aggressive media.

5 Claims, No Drawings

PROCESS FOR THE CONSTRUCTION OF A GAS-TIGHT, THERMALLY INSULATED LINING FOR A FREE-STANDING STACK

The subject of the invention is a process for the construction of a gas-tight, thermally-insulated lining of masonry or concrete, which is resistant to aggressive media, such as acid condensates and/or dissolved salts, for a free-standing stack.

Limiting the permissible emissions from power station and industrial stacks requires additional cleaning measures which make considerable changes in the nature of the waste gas compared with former times. For thermal power stations, particularly those that are coal-fired, wet scrubbing with milk of lime has proved the most satisfactory. However, this produces completely different operating conditions in the stacks positioned downstream, which require corresponding changes in the construction of the lining. Wet scrubbing increases the content of water vapor and reduces the temperature of the flue gas introduced into the stack. The residual content of harmful substances which has not been removed can form acid condensate. The flue gas also contains entrained saliferous water droplets from the washing process. Stacks with masonry linings are therefore usually used downstream of wet-washing prccesses. The lining is composed of acid-resistant masonry of ceramic bricks with acid-resistant grouting. In fairly large chimneys the lining is divided up into separate parts, so-called sections, which are separated from the supporting shaft by an intervening access space in a system known as step-by-step lining. A thermal insulation layer of closed-cell cellular glass (foam glass), approximate thickness 50 to 60 mm, can be provided on the outer side of a lining of this type for thermal insulation. A safety gap of 10 to 20 mm is left between the layer of thermal insulation and the masonry.

The ceramic lining is neither liquid-tight nor gas-tight. Although the cellular glass itself is fully sealed, it is not entirely possible, in conjunction with the safety gap, to avoid permeable points in the region of the grouting and of the contact surfaces at the base of the lining. Even more critical is the impermeability of the junction between the separate sections of the lining. There is still no practical solution to sealing the expansion gaps. The purpose of the invention is therefore to provide a process for the construction of an acid-resistant stack lining which is thermally insulating as well as liquid-tight and gas-tight.

The invention solves the problem by placing a laminate of glass fiber and multi-component reactive resin, and on top of this a layer of thermal insulation, on the outer side of the prior art lining, which is, e.g., that specified in the Deutsche Norm DIN 1056. Stack ties can be provided between the laminate and the layer of thermal insulation.

The invention offers the following advantages when compared with prior art stack linings:

Under all possible operating conditions the continuous liquid-tight and gas-tight laminate prevents penetration of waste gas into the intervening access space, even in the region of lining joints.

The invention makes it possible to use insulating materials which are inexpensive and easy to erect, such as glass wool or mineral wool, instead of the expensive cellular glass.

By using the appropriate content of glass fibers or rovings, the laminate layer can be adapted to an internal gas overpressure. This permits higher waste gas velocities, and consequently lower internal lining diameters, and thus reduces the erection costs; it can, however, also be of importance when equipping an old stack with a new lining which may be necessary, for instance, because of subsequent installation of a flue gas scrubber.

By use of load-distributing chimney ties, it is possible to avoid the formation of cracks caused by, for instance, temperature fluctuations.

Suitable multicomponent reaction resins are, for example, phenolic resins, furan resins, epoxy resins, unsaturated polyester or polyurethane resins. Typical resins are those commonly used in acid-proof constructions, e.g. Asplit® cement, or in laminate technics, e.g. phenol-resole with a range of phenol to formaldehyde of 1:1.2 to 1:1.8 or exoxy resin of the Beckopox® EP 140 (=Epicote® 828) type. By suitable selection of resin and hardener it is possible to shrink the laminate onto the outer side of the lining by means of the contraction during hardening. The laminate of glass fiber and multicomponent reaction resin is placed without joints on the outer side of the lining, even in the region of the lining joints and the contact surfaces at the base of the lining. In the region of the expansion gap the laminate can be constructed in the form of an expansion loop. Bellows-type transition pieces of flexible synthetic material with good chemical and thermal resistance, such as fluoroplastics, can also be incorporated into the laminate. Under the contact surfaces at the base of the lining, the laminate can be placed on the reinforced concrete load-bearing structure, if necessary by means of an intermediate layer. The stack ties can be made of steel or stainless steel.

I claim:

1. A process for rendering gas-pressure-tight and thermally-insulating a masonry or concrete lining of a free-standing stack, which lining is resistant to aggressive media, the process comprising covering the lining sequentially with a laminate of glass fiber and multicomponent reactive resin and with a layer of thermal insulation.

2. A process as claimed in claim 1, which further comprises providing stack ties between the laminate and the layer of thermal insulation.

3. A lining of a free-standing stack covered sequentially with (a) a continuous liquid-tight and gas-tight laminate of glass fiber and multicomponent reactive resin and with (b) a layer of thermal insulation.

4. A lining a claimed in claim 3, which is a masonry or concrete lining which is resistant to agressive media.

5. A gas-pressure-tight and thermally-insulating lining for a free-standing stack comprising a coating of a laminate of glass fiber and multicomponent reactive resin, which coating is virtually completely covered by a layer of thermal insulation.

* * * * *